US007707651B2

(12) United States Patent
White

(10) Patent No.: US 7,707,651 B2
(45) Date of Patent: May 4, 2010

(54) CONVERTIBLE MATERNITY COAT

(76) Inventor: Barbara E. White, 376 Highland Ave., San Francisco, CA (US) 94110

( * ) Notice: Subject to any disclaimer, the term of this patent is extended or adjusted under 35 U.S.C. 154(b) by 0 days.

(21) Appl. No.: 12/148,699

(22) Filed: Apr. 21, 2008

(65) Prior Publication Data

US 2008/0256679 A1 Oct. 23, 2008

Related U.S. Application Data

(60) Provisional application No. 60/925,238, filed on Apr. 19, 2007.

(51) Int. Cl.
*A41D 1/02* (2006.01)
*A41D 1/00* (2006.01)

(52) U.S. Cl. ..... 2/96; 2/108

(58) Field of Classification Search ..... 2/108, 2/96, 105, 106, 94, 95, 88, 993, 269, 171
See application file for complete search history.

(56) References Cited

U.S. PATENT DOCUMENTS 2,779,944 A * 2/1957 Flach ..... 2/85
3,094,703 A * 6/1963 Bailey ..... 2/96
3,110,903 A * 11/1963 Burchard ..... 2/221
3,230,545 A * 1/1966 Galley ..... 2/74
4,606,078 A 8/1986 Tkacsik
4,683,595 A 8/1987 Cash
5,341,514 A * 8/1994 Dale ..... 2/96
5,351,343 A * 10/1994 Harbison ..... 2/423
5,718,000 A * 2/1998 Ost et al. ..... 2/69
6,370,692 B1 * 4/2002 Duyn et al. ..... 2/86
2006/0000004 A1 1/2006 Elen

* cited by examiner

*Primary Examiner*—Gloria Hale
(74) *Attorney, Agent, or Firm*—Donald L. Bartels; Bartels Law Group

(57) ABSTRACT

A two panel convertible maternity coat that can be used by a woman before, after, and during pregnancy, a pregnancy panel, and a baby panel. Pregnancy is accommodated through the addition of the pregnancy panel between the front sides of the coat. The pregnancy panel is wider at the bottom and tapered toward the top. The two panel convertible maternity coat also can be used as a garment for covering both baby and mother, father, or other wearer though the addition of the baby panel between the front sides of the coat. The baby panel is shaped wider at the top and tapers down to a lower portion. Means are provided for readily fastening each panel separately to the coat so as to provide for ease in transitioning between the uses of the coat.

5 Claims, 4 Drawing Sheets

CONVERTIBLE MATERNITY COAT

CROSS REFERENCE TO RELATED APPLICATION

This application claims the benefit of U.S. Provisional Application No. 60/925,238, filed Apr. 19, 2007, which is incorporated by reference herein.

FIELD OF THE INVENTION

The invention relates in general to outerwear garments, and more specifically to a convertible maternity coat transformable for use by a woman before and during pregnancy, and, after birth of the baby, for covering both baby and mother, father, or other wearer of the coat.

BACKGROUND OF THE INVENTION

Outerwear garments that can be converted for other uses are known in the art. For example, some coats include removable linings to permit use in different temperature conditions. Maternity coats for use by women before, during and after pregnancy are also known. Maternity coats have also been designed for use during pregnancy and afterwards, to cover both baby and mother, father, or other wearer of the coat. The conventional maternity coats, however, do not provide the flexibility and ease of transitioning from a coat for use during pregnancy to a coat for use by both mother, or other wearer, and baby. One known coat has an extra zip-in panel to be worn both during pregnancy and with baby, i.e., a one panel coat. The one panel coat was designed to function as a maternity coat during pregnancy and, secondly, as a coat for use after pregnancy by both mother or other wearer and baby. A drawback of known one panel coat designs is the coat provides too much fabric at the top, near the bust and neck during pregnancy. This excess of fabric was very cumbersome to the wearer and made the coat less functional as a maternity coat. Further, it was also difficult for the wearer to stay warm using the one panel coat since the neck area was more exposed.

Another drawback of the single panel coat is that it did not successfully accommodate the baby in utero or after birth. The reason for this is that the bottom of the known panel was typically too narrow, not allowing enough room on the lower half for the baby as it grows larger in utero. In addition, the excess fabric at the top of the coat was open to accommodate the baby, but since the same piece of fabric had to be used by the mother during pregnancy, it could not be shaped to accommodate the true needs of the baby. Another drawback of known one panel and other known convertible maternity coats is that the coats do not provide the flexibility to enable easy transitioning to provide the two functions, i.e. for use during pregnancy by the mother and for use by both mother, father, or other wearer and baby after the baby has been born.

There is therefore a need for a convertible maternity coat that separates the functions of a coat for the mother during pregnancy and a coat after birth for the mother or other wearer and baby. That is, there is a need for a convertible maternity coat that provides a removable panel designed just for use during pregnancy and another removable panel designed to enable both the new-born baby and the mother, father or other wearer to be covered comfortably. There is also a need for a coat that provides a panel designed for pregnancy that has no excess fabric at the top, so as to keep the wearer warmer and more comfortable.

There is also a need for a convertible maternity coat that enables the easy transition between various functions, e.g., for use by the mother during pregnancy and by both baby and mother, father, or other wearer after the baby is born.

SUMMARY OF THE INVENTION

The present invention provides a convertible maternity coat that overcomes the drawbacks of known designs. Broadly stated, the present invention provides a wearable and convertible maternity outerwear garment, comprising a coat having two sleeves and left front and right front portions, each attached to and extending from a back portion; a first fastener for securing the left front and right front portions together and for enabling the addition of a first panel or a second panel to the coat; wherein the first panel is wider at the top and tapered from the top to the bottom and shaped for wrapping around a baby and for accommodating growth of the baby, the first panel including a second fastener for securing the first panel to the coat; and wherein the second panel is wider at the bottom and tapered from the bottom to the top and shaped to accommodate growth of a mother during pregnancy, the second panel including a third fastener for securing the second panel to the coat.

Broadly stated, the present invention also provides in one embodiment, a wearable and convertible maternity outerwear garment, comprising: a coat having two sleeves and left front and right front portions, each attached to and extending from a back portion; a first zipper for securing the left front and right front portions together for joining said front portions and for enabling the addition of a first panel or a second panel to the coat; wherein the first panel is wider at the top and tapered from the top to the bottom and shaped for wrapping around a baby and for accommodating growth of the baby, the first panel including a second zipper for securing the first panel to the coat, the first and second zippers enabling detachment of one or both sides of the first panel from the coat for unwrapping the first panel from the baby, the first panel including a left upper portion, a substantially U-shaped center upper portion, and a right upper portion, the left and right upper portions for wrapping around at least a portion of the neck of the baby to enable the center upper portion to cover at least a portion of the throat of the baby; wherein the second panel is wider at the bottom and tapered from the bottom to the top and shaped to accommodate growth of a mother during pregnancy, the second panel including a third zipper for securing the second panel to the coat; and a snap for securing the left upper and right upper portions of the second panel to join the left upper and right upper portions for providing cover of at least a portion of the throat of the mother, father, or other wearer; and means for enabling addition of a hood.

An advantage of the convertible maternity coat according to the present invention is that it includes an additional panel designed to be used just during pregnancy, i.e., a pregnancy panel. The pregnancy panel has substantially no excess fabric at the top such that the wearer is kept warmer and more comfortable than with conventional maternity coats.

Another advantage of the convertible maternity coat according to the present invention is that it provides a separate baby panel shaped to wrap around the new-born baby without excess fabric. By providing a separate panel for the baby, it enables the fabric to encircle the baby and the neck area of the mother, father, or other wearer, and thereby prevents the lack of warmth around the neck of the wearer caused by conventional maternity coats. Further, the lower portion of the baby panel of the coat of the present invention is shaped to allow for substantial growth of the baby. Due to the increased size of the lower portion of the baby panel, another advantage according to one embodiment of the present invention is the addition of a supply pocket to the baby panel to further increase the maternity coat's versatility.

Another advantage according to one aspect is that the convertible maternity coat of the present invention provides for ease of transition between the various functional uses of the coat. Another advantage according to one embodiment of the present invention is the addition of a separate baby hat.

Another advantage according to one embodiment of the present invention is the addition of a removable hood for the mother. Still another advantage according to another embodiment is a quilted lining for added warmth. Another advantage according to another embodiment is ribbed cuffs for increased comfort. Yet another advantage according to one embodiment is the providing of double-headed zippers for each side of the pregnancy panel and baby panel when included in the maternity coat, to enable unzipping or partial unzipping in either direction.

These and other embodiments, features, aspects, and advantages of the present invention will become better understood with reference to the following description, appended claims and accompanying drawings.

Reference symbols or names are used in the Figures to indicate certain components, aspects or features shown therein, with reference symbols common to more than one Figure indicating like components, aspects or features shown therein.

DETAILED DESCRIPTION OF THE INVENTION

Figure 1:
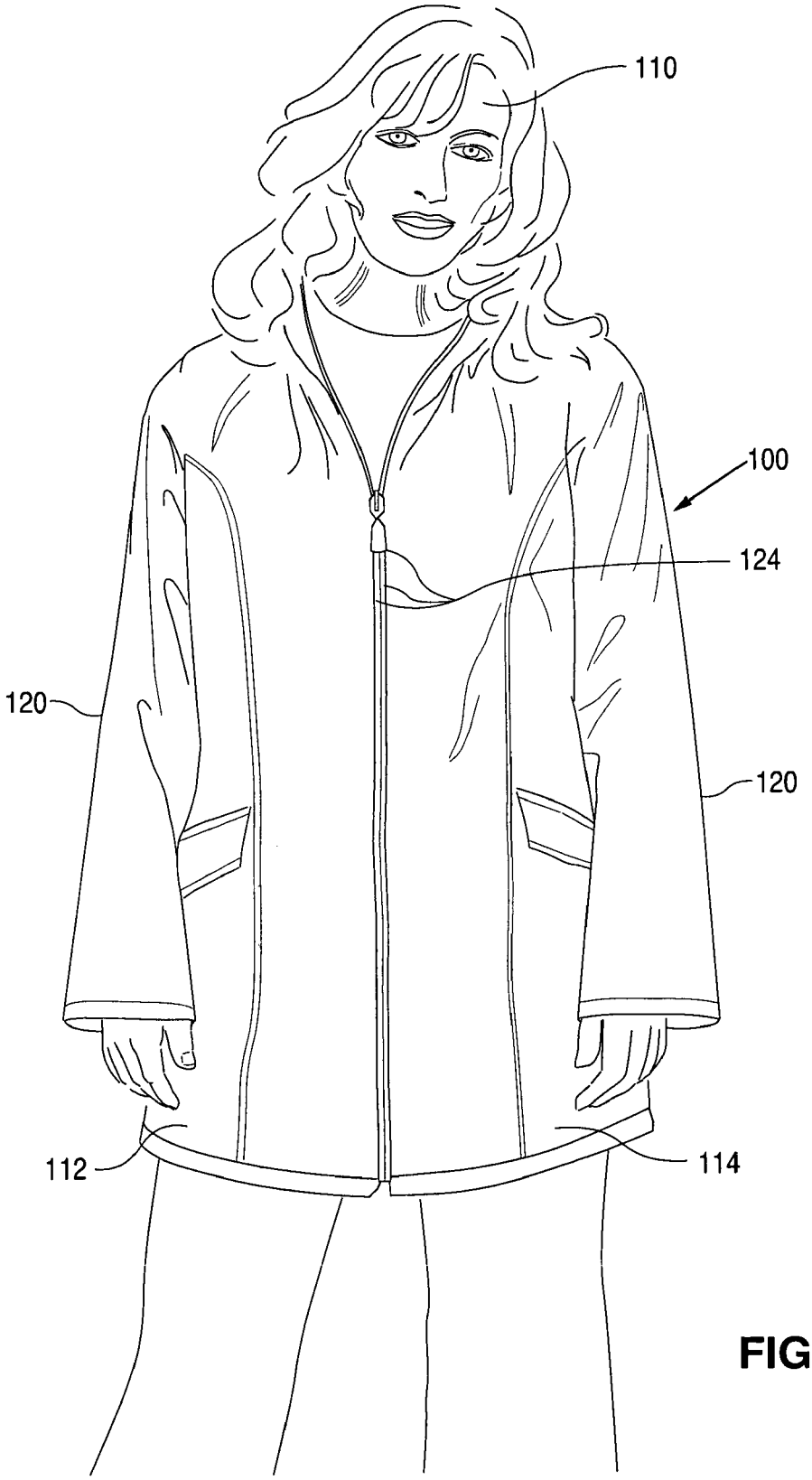
FIG. 1 is a view of the convertible maternity coat without additional panels according to an embodiment of the present invention.
Figure 2:
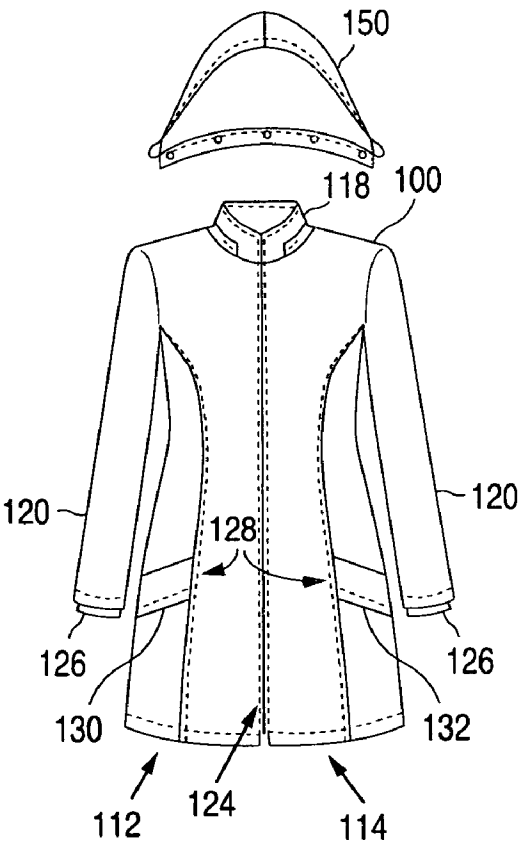
FIG. 2 is a front view of the convertible maternity coat in FIG. 1 including a detachable hood according to an preferred embodiment of the present invention.

FIG. 1 is a view of the convertible maternity coat 100 without additional panels according to an embodiment of the present invention. The convertible maternity coat 100 provides a convertible maternity coat for use by person 110 before and during pregnancy and after birth of the baby 160. The convertible maternity coat 100 is preferably made of a water resistant material for all season use. FIG. 2 is a front view of the convertible maternity coat 100 in FIG. 1 including a detachable hood 150 according to a preferred embodiment of the present invention.

Figure 3:
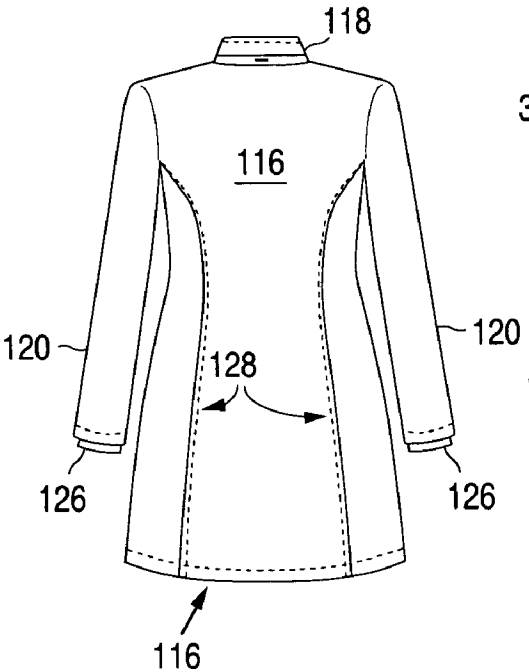
FIG. 3 is a rear view of the convertible maternity coat in FIG. 1.

FIG. 3 is a rear view of the convertible maternity coat in FIG. 1. The convertible maternity coat 100 has an outer shell preferably of a lightweight water resistant material such as nylon having left and right front portions 112, 114, one back portion 116, a collar 118, sleeves 120 and a zipper 124. The sleeves 120 and the left front and right front portions 112, 114 are attached to and extend from the back portion 116. Preferably, zipper 124 is a double-headed zipper, i.e., enabling either partial or complete unzipping in either direction. An interior knit cuff 126 at the end of each sleeve 120 is preferably ribbed.

The convertible maternity coat 100 and hood 150 are preferably each lined with quilted fabric and have a nylon outer surface. Preferably, the hood 150 includes an elastic draw cord for cinching and is detachable from convertible maternity coat 100. The collar 118 of convertible maternity coat 100 is preferably shaped like a nehru collar, as shown best in the front view in FIG. 2 and the rear view in FIG. 3. The convertible maternity coat 100 preferably has front and back seams 128. Angled flat pockets 130, 132 on the left and right front portions 112, 114, respectively, are preferably provided.

Figure 5:
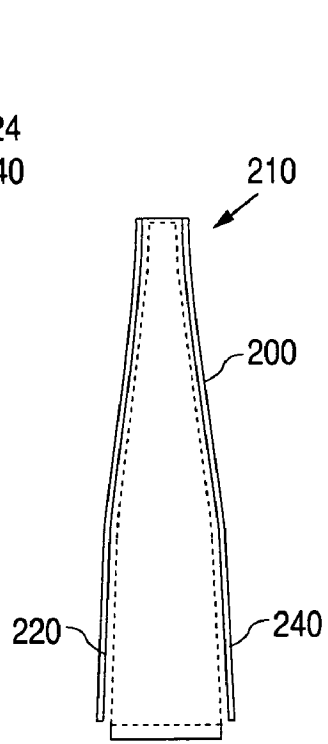
FIG. 5 is a view of the pregnancy panel according to an embodiment of the present invention.
Figure 4:
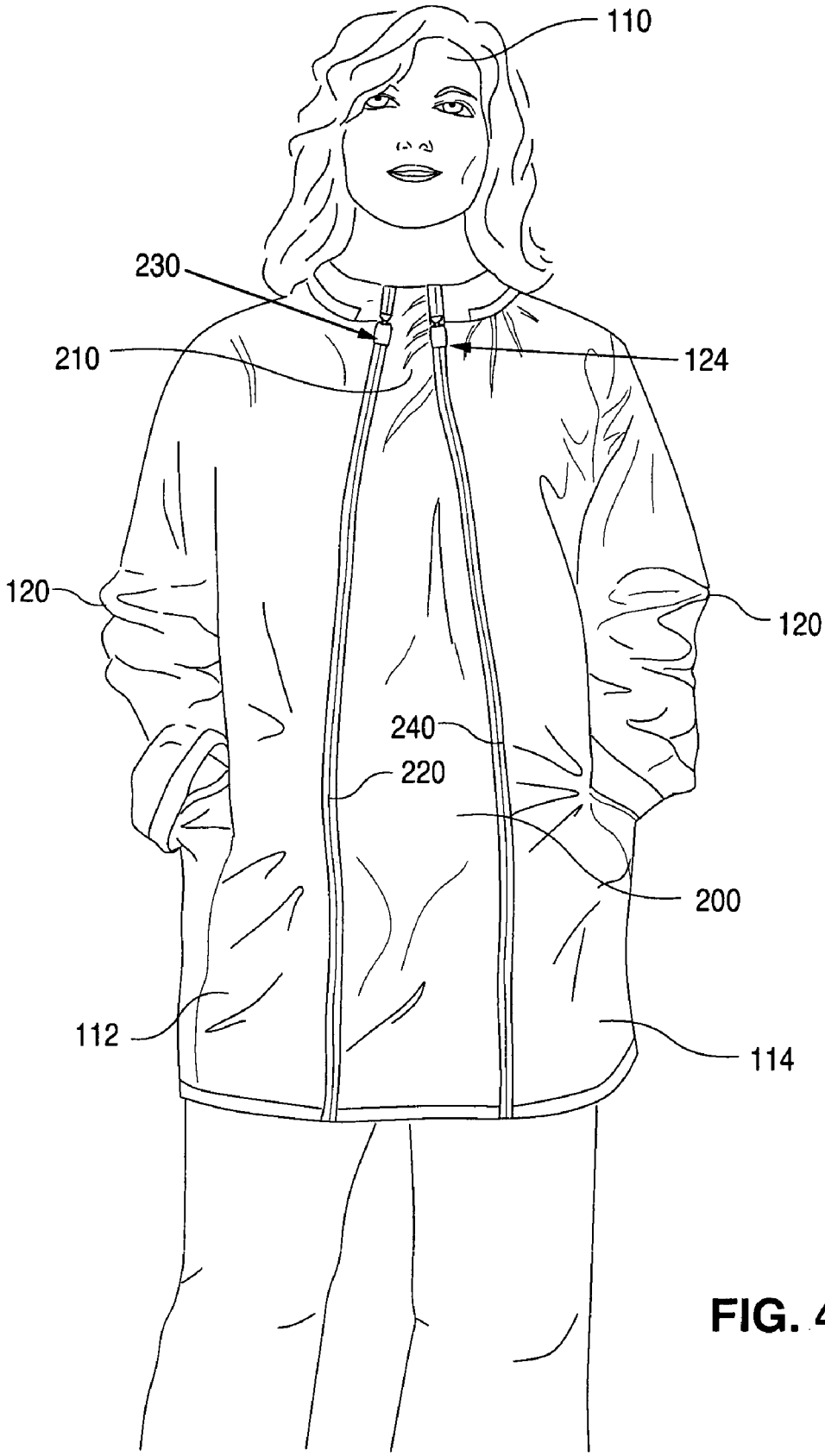
FIG. 4 is a front view of the convertible maternity coat in FIG. 1 including a pregnancy panel attached thereto according to an embodiment of the present invention.

FIG. 4 is a front view of the convertible maternity coat in FIG. 1 including a pregnancy panel 200 attached thereto according to an embodiment of the present invention. FIG. 5 is a view of the pregnancy panel according to an embodiment of the present invention.

The pregnancy panel 200 fastens to the zipper 124 of convertible maternity coat 100. The zipper 124 preferably has two rows of metal toothed edges (teeth) on strips of tape and a sliding piece that closes an opening by drawing the teeth together. Alternatively, the teeth are plastic or another suitable material. A first row of teeth is attached to left front portion 112 and a second row of teeth is attached to right front portion 114. The sliding piece may be positioned on either row of teeth.

The pregnancy panel 200 preferably includes a double-headed zipper 230 that includes one row of teeth, including a double headed sliding piece, along a side 220 and another row of teeth along a side 240. One skilled in the art would appreciate that the location of the sliding piece on either row of teeth is a matter of design choice. The double headed sliding piece of pregnancy panel 200 is for attaching to the row of teeth of convertible maternity coat 100 that does not have a sliding piece. The row of teeth along side 240 in this example is for attaching to the row of teeth of convertible maternity coat that does include the sliding piece. Each sliding piece closes the opening, joining the pregnancy panel with the convertible maternity coat 100. FIG. 4 shows an exemplary convertible maternity coat with pregnancy panel where the zippers are fully joining the pregnancy panel sides 220, 240 to the zipper 124 of convertible maternity coat 100. The design of the pregnancy panel 200 and convertible maternity coat 100 thus provides for ease of transition between use by a woman before or after pregnancy and during pregnancy.

As seen in the examples in FIGS. 4 and 5, the pregnancy panel 200 is narrower at the top than the bottom, i.e., tapered from bottom to top. The pregnancy panel 200 is designed just for pregnancy, in that it is wider at the waist and has no excess fabric at the top 210, so that the wearer is kept warmer and more comfortable than with conventional maternity coats. The pregnancy panel 200 is preferably the same color and designed of the same material as the convertible maternity coat 100.

Figure 7:
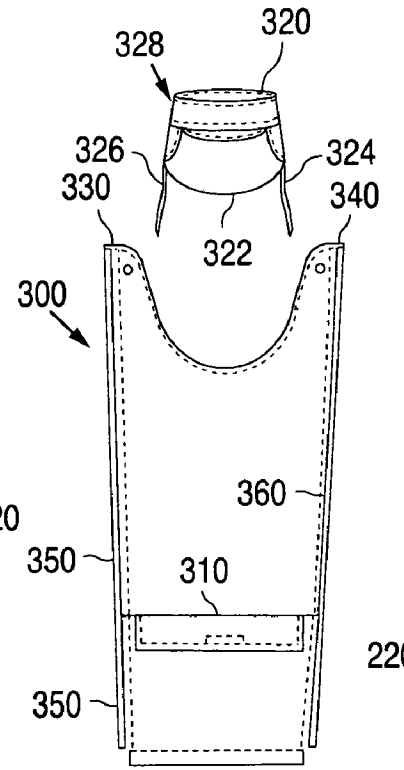
FIG. 7 is a front view of the baby panel of FIG. 6 having a pocket and providing a separate baby hat according to an embodiment of the present invention.
Figure 6:
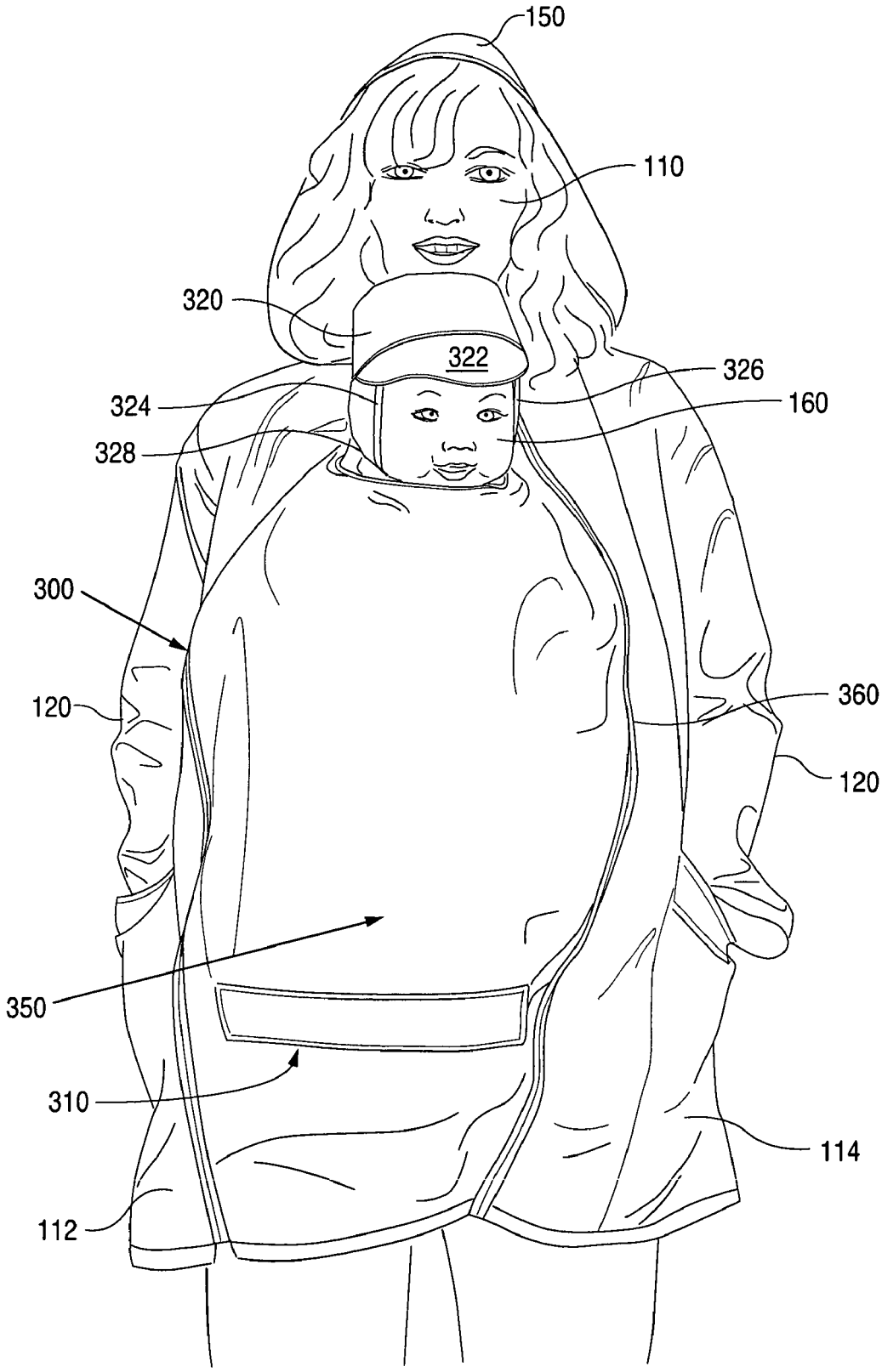
FIG. 6 is a front view of the convertible maternity coat in FIG. 1 including a baby panel attached thereto having a pocket, and a separate baby hat according to a preferred embodiment of the present invention.

The convertible maternity coat of the present invention also enables use during maternity so as to accommodate the increased size of the mother during pregnancy. FIG. 6 is a front view of the convertible maternity coat in FIG. 1 including a baby panel 300 attached thereto having a pocket 310, and a separate baby hat 320 according to a preferred embodiment of the present invention. FIG. 7 is a front view of the baby panel 300 of FIG. 6 having a pocket 310 and the separate baby hat 320. The convertible maternity coat 100 with baby panel 300 is for use for a mother, father, or other wearer having the baby in some type of baby carrier (not shown). The baby in the baby carrier can be facing out or facing in. The convertible maternity coat 100 with baby panel 300 provides coverage to warm both the mother, father, or other wearer and the baby. The separate baby panel 300 is shaped, as best seen in FIG. 7, to wrap around the baby without excess fabric. A fastening means is provided to secure the top left 330 and top right panel 340 of the baby panel 300. Preferably, snaps are provided for the fastening means. Alternatively, VELCRO may be used for the fastening means. By providing a separate panel for the baby, the lack of warmth around the neck of the mother, father, or other wearer due to conventional maternity coats is overcome by encircling the baby and the mother's neck areas.

The width of the baby panel 300 is narrower at the bottom than at the top, as seen best in FIG. 7. The lower portion 350 is shaped to allow for substantial growth of the baby. The increased lower portion for accommodating growth of the baby preferably includes the pocket 310 to enable the storing of supplies for the baby, thus further increasing the coat's versatility. Preferably, the pocket 310 is in the center of the lower portion of baby panel 300 and includes a conventional fastening means, e.g., hook and loop closure, VELCRO, etc. The baby panel 300 preferably has the same outer fabric and lining as the convertible maternity coat 100.

The baby panel 300 is preferably attached to the convertible maternity coat 100 via a fastener, preferably zippers. The baby panel 300 preferably includes a double-headed zipper having one row of teeth including a double headed sliding piece along a side 350 and another row of teeth along a side 360. One skilled in the art would appreciate that the location of the sliding piece on either row is a matter of design choice. The double headed sliding piece of baby panel 300 is for attaching to the row of teeth of convertible maternity coat 100 that does not have a sliding piece. The row of teeth along side 360 in this example is for attaching to the row of teeth of convertible maternity coat that does include the sliding piece. Each sliding piece closes the opening, joining the pregnancy panel with the convertible maternity coat 100.

In the example in FIG. 6, the convertible maternity coat 100 with baby panel 300 is shown with the zippers fully joining the baby panel's sides 350, 360 to the zipper 124 of convertible maternity coat 100. The design of the baby panel 300 and convertible maternity coat 100 thus provides for ease of transition between use by a woman with baby, and before or after maternity. According to one exemplary use, the pregnancy panel 200 can be easily replaced with the baby panel 300 for use by both mother and child; or even for use by father or other wearer and child. Thus, another advantage according to one aspect is that the convertible maternity coat of the present invention provides for ease of transition between the various functional uses of the coat.

The two panel convertible maternity coat of the present invention thus enables use with no panels, with the addition of the pregnancy panel 200, or with the addition of the baby panel 300. In addition, the preferred double headed sliders for the zippers enable unjoining of one or both sides of the added panel from the coat for example, to remove the baby for placing into a car seat, to increase an opening to allow more air for cooling, and for easy removal of the coat.

The baby hat 320 preferably has a front visor 322, and earflaps 324, 326. The baby hat 320 also preferably includes a back sun/weather protection flap 328 a portion of which is visible in the example FIG. 6. Flap 328 is a known flap used for sun/weather protection.

According to one example, during pregnancy, the user can zip the baby panel 300 into the front of the convertible maternity coat 100. The arrangement allows the wearer to customize fit to changing needs, e.g., open top of zip panel, carry baby in a sling or front-pack; put the coat on and take off without waking baby, and protect baby from the wind, cold, rain and snow. After the baby is past the being-carried stage, the convertible maternity coat user can remove the baby panel 300 and use the convertible maternity coat without any additional panel as in the example in FIG. 1.

Having disclosed exemplary embodiments, modifications and variations may be made to the disclosed embodiments while remaining within the scope of the invention as described by the following claims.

What is claimed is:

1. A wearable and convertible maternity outerwear garment, comprising:

a coat having two sleeves and left front and right front portions, each attached to and extending from a back portion;

a first fastener for securing the left front and right front portions together and for enabling the addition of a first panel or a second panel to the coat;

wherein the first panel is wider at the top and tapered from the top to the bottom for wrapping around a baby and for accommodating growth of the baby, the first panel having first and second opposing sides and including a second fastener for securing the first panel to the coat, the second fastener comprising a first portion along the first side and a second portion along the second side; and wherein the first panel includes left upper, center upper, and right upper portions, the left and right upper portions comprising shoulder extensions extending from opposite sides of the center upper portion for wrapping over corresponding shoulders of the baby to cover a substantial portion of the neck of the baby; and wherein the second panel is wider at the bottom and tapered from the bottom to the top—for accommodating growth of a mother during pregnancy, the second panel having third and fourth opposing sides and including a third fastener for securing the second panel to the coat, the third fastener comprising a third portion along the third side and a fourth portion along the fourth side.

2. The outerwear garment of claim 1, further comprising a fourth fastener having a fastener half attached to the left upper portion and another fastener half attached to the right upper portion, the fourth fastener for securing the left upper and right upper portions of the first panel for providing cover for at least a portion of the throat of the mother, father, or other wearer.

3. A wearable and convertible maternity outerwear garment, comprising:

a coat having two sleeves and left front and right front portions, each attached to and extending from a back portion;

a first fastener for securing the left front and right front portions together and for enabling the addition of a first panel or a second panel to the coat;

wherein the first panel is wider at the top and tapered from the top to the bottom for wrapping around a baby and for accommodating growth of the baby, the first panel having first and second opposing sides and including a second fastener for securing the first panel to the coat, the second fastener comprising a first portion along the first side and a second portion along the second side;

wherein the first panel includes left upper, center upper, and right upper portions, wherein the center upper portion is substantially upright U-shaped, the left and right upper portions comprising shoulder extensions extending from opposite sides of the center upper portion for wrapping over corresponding shoulders of the baby to cover a substantial portion of the neck of the baby;

a fourth fastener having a fastener half attached to the left upper portion and another fastener half attached to the right upper portion, the fourth fastener for securing the left upper and right upper portions of the first panel for providing cover for at least a portion of the throat of the mother, father, or other wearer; and wherein the second panel is wider at the bottom and tapered from the bottom to the top for accommodating growth of a mother during pregnancy, the second panel having third and fourth opposing sides and including a third fastener for securing the second panel to the coat, the third fastener comprising a third portion along the third side and a fourth portion along the fourth side.

4. A wearable and convertible maternity outerwear garment, comprising:

a coat having two sleeves and left front and right front portions, each attached to and extending from a back portion;

a first zipper for securing the left front and right front portions together for joining said front portions and for enabling the addition of a first panel or a second panel to the coat;

wherein the first panel is wider at the top and tapered from the top to the bottom for wrapping around a baby and for accommodating growth of the baby, the first panel including a second zipper for securing the first panel to the coat, the first and second zippers enabling detachment of one or both sides of the first panel from the coat for unwrapping the first panel from the baby, the first panel including a left upper portion, a substantially upright U-shaped center upper portion, and a right upper portion, the left and right upper portions for wrapping around at least a portion of the neck of the baby to enable the center upper portion to cover at least a portion of the throat of the baby;

wherein the second panel is wider at the bottom and tapered from the bottom to the top for accommodating to accommodate growth of a mother during pregnancy, the second panel including a third zipper for securing the second panel to the coat;

and a snap for securing the left upper and right upper portions of the first panel to join the left upper and right upper portions for providing cover of at least a portion of the throat of the mother, father, or other wearer, the snap comprising mating snap halves including a first snap half attached to the left upper portion and a second snap half attached to the right upper portion; and means for enabling the addition of a detachable hood.

5. The outerwear garment of claim 4, further comprising a separate hat for the baby; the hat including a visor attached to and extending from a front portion of the hat, two earflaps, and another flap attached to and extending from a back portion of the hat.

* * * * *